US009083089B2

(12) United States Patent
Petrucci et al.

(10) Patent No.: US 9,083,089 B2
(45) Date of Patent: Jul. 14, 2015

(54) ELECTRICAL GROUNDING AND STRUCTURAL DEVICE FOR DISSIMILAR METAL COMPONENTS

(71) Applicant: GM Global Technology Operations LLC, Detroit, MI (US)

(72) Inventors: David R. Petrucci, Warren, MI (US); Harpal Singh, Rochester, MI (US); Donald R. Seyerle, Grand Blanc, MI (US); William A. Schumacher, South Lyon, MI (US); Louis Meli, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 189 days.

(21) Appl. No.: 13/937,308

(22) Filed: Jul. 9, 2013

(65) Prior Publication Data

US 2015/0014055 A1 Jan. 15, 2015

(51) Int. Cl.

| | |
|---|---|
| ***H01R 4/02*** | (2006.01) |
| ***H01B 1/02*** | (2006.01) |
| ***H01R 43/04*** | (2006.01) |
| ***H01R 4/62*** | (2006.01) |
| ***H01R 43/16*** | (2006.01) |

(52) U.S. Cl.

CPC ..... *H01R 4/029* (2013.01); *H01B 1/02* (2013.01); *H01R 4/62* (2013.01); *H01R 43/04* (2013.01); *H01R 43/16* (2013.01); *H01R 2201/26* (2013.01); *Y10T 29/49218* (2015.01)

(58) Field of Classification Search

CPC ..... H01B 1/00; H01B 1/02; H01R 4/029; H01R 4/10; H01R 4/14; H01R 43/04; H01R 43/048; H01R 4/62; H01R 43/16; H01R 2201/26; H02G 5/00; H02G 5/002; Y10T 29/49218; H02B 1/20; H02B 1/21

USPC .... 174/68.2, 72 B, 71 B, 88 B, 70 B, 99 B, 6, 174/5 SG, 51, 94 R, 78, 128.2, 126.2, 133 B, 174/356; 361/1, 611, 637, 648, 775, 624; 29/882, 592, 592.1; 439/212, 213, 114, 439/210, 887; 428/594

See application file for complete search history.

(56) References Cited

U.S. PATENT DOCUMENTS

| | | | | |
|---|---|---|---|---|
| 4,485,960 | A | 12/1984 | Sagan et al. | |
| 4,934,952 | A | 6/1990 | Banker | |
| 5,202,536 | A * | 4/1993 | Buonanno | 174/356 |
| 5,298,683 | A | 3/1994 | Taylor | |
| 5,909,005 | A * | 6/1999 | Boston | 174/51 |

(Continued)

*Primary Examiner* — Angel R Estrada
(74) *Attorney, Agent, or Firm* — Cantor Coburn LLP

(57) ABSTRACT

In one exemplary embodiment of the invention, an electrical grounding device for dissimilar metals is provided. The device includes a body comprising adjacent first and second plate portions, the body including a first surface formed from a first metal and an opposite second surface formed from a second metal. The first plate portion is folded onto the second plate portion such that a portion of the first surface of the first plate portion contacts a portion of the first surface of the second plate portion. The first surface of the first plate portion is configured to couple to a first component formed from the first metal and the second surface of the second plate portion is configured to couple to a second component formed from the second metal, the body electrically coupling the first component and the second component to facilitate electrically connecting the first and second components.

20 Claims, 3 Drawing Sheets

(56) References Cited

U.S. PATENT DOCUMENTS 6,398,596 B1 * 6/2002 Malin ..... 174/78
6,933,442 B2 * 8/2005 Franks, Jr. ..... 174/51
2011/0097594 A1 * 4/2011 Tanaka et al. ..... 428/594
2015/0024643 A1 * 1/2015 Petrucci ..... 439/887

* cited by examiner

ELECTRICAL GROUNDING AND STRUCTURAL DEVICE FOR DISSIMILAR METAL COMPONENTS

FIELD OF THE INVENTION

The subject invention relates generally to devices for connecting dissimilar metal components and, more specifically, to devices for coupling and grounding dissimilar metal vehicle components.

BACKGROUND

Some known vehicles require electrical coupling and common grounding of on-board metal structures and equipment to prevent, for example, inductive pickup of electrical signals. When components cannot be integrally or metallurgically joined to other structures, coupling is typically accomplished through the use of metal straps sometimes referred to as bonding straps. Such bonding straps are typically constructed of copper cable with copper alloy or aluminum end fittings, depending on the types of metals being bonded. Frequently, the bonding straps are used to couple components constructed of galvanically different metals, such as aluminum and steel, which can react destructively when they contact each other in a corrosive environment. This is caused by the galvanic incompatibility of the two materials and results in the destruction of one or both of the materials and reduced or eliminated electrical contact therebetween.

Some known bonding straps are constructed of copper cable to optimize electrical conductivity. At each end of the cable is an attached lug of a metal type selected to provide metallurgical compatibility with the metal of the component to which the lug is to be attached. When components to be bonded are of different metal types, the lugs on each end of the strap may be of a different type to match the metal to which they will be mated; creating dissimilar metal interfaces in the bonding strap itself Because of the difficulty of welding the various metals of the strap construction together by conventional means, the components of the strap may be mechanically joined, which may create crevices and interstices in which corrosion may become localized and accelerated.

SUMMARY OF THE INVENTION

In one exemplary embodiment of the invention, an electrical grounding device for dissimilar metals is provided. The device includes a body comprising adjacent first and second plate portions, the body including a first surface formed from a first metal and an opposite second surface formed from a second metal. The first plate portion is folded onto the second plate portion such that a portion of the first surface of the first plate portion contacts a portion of the first surface of the second plate portion. The first surface of the first plate portion is configured to couple to a first component formed from the first metal and the second surface of the second plate portion is configured to couple to a second component formed from the second metal, the body electrically coupling the first component and the second component to facilitate electrically connecting the first and second components.

In another exemplary embodiment of the invention, a vehicle is provided. The vehicle includes a first vehicle component fabricated from a first metal, a second vehicle component fabricated from a second metal, and a coupling device. The coupling device includes a body comprising adjacent first and second plate portions, the body including a first surface formed from the first metal and an opposite second surface formed from the second metal. The first plate portion is folded onto the second plate portion such that a portion of the first surface of the first plate portion contacts a portion of the first surface of the second plate portion. The first surface of the first plate portion is coupled to the first vehicle component and the second surface of the second plate portion is coupled to the second vehicle component, the body coupling the first and second vehicle components.

In yet another exemplary embodiment of the invention, a method of manufacturing an electrical grounding device for dissimilar metals is provided. The method includes providing a body having a first surface formed from a first metal and an opposite second surface formed form a second metal, forming the body to include adjacent first and second plate portions, and folding the first plate portion onto the second plate portion such that a portion of the first surface of the first plate portion contacts a portion of the first surface of the second plate portion. The first surface of the first plate portion is configured to couple to a first component formed from the first metal, and the second surface of the second plate portion is configured to couple to a second component formed from the second metal, the body electrically coupling the first and second components.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
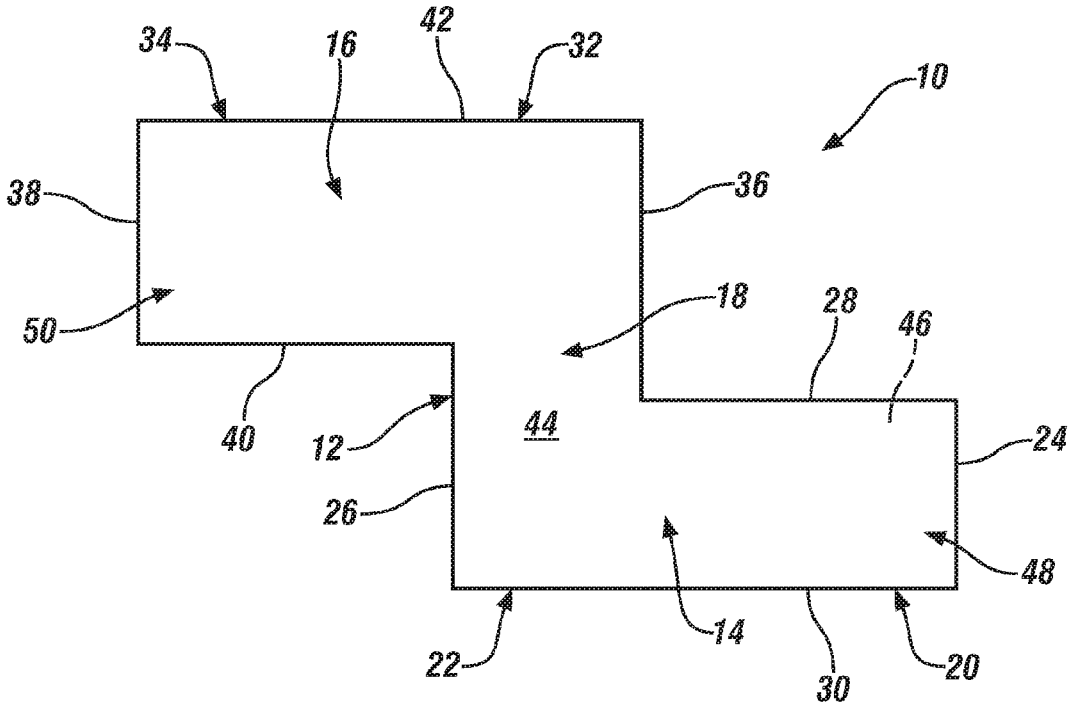
FIG. 1 is a schematic view of an exemplary electrical grounding device before a folding process.

The following description is merely exemplary in nature and is not intended to limit the present disclosure, its application or uses. It should be understood that throughout the drawings, corresponding reference numerals indicate like or corresponding parts and features.

Described herein are exemplary electrical grounding and structural devices for coupling two components fabricated from dissimilar metals. The devices generally provide opposite surfaces each formed from a metal similar to the component they will couple with. Accordingly, the present devices reduce or prevent galvanic corrosion that may occur, for example, when using some known bond straps to couple dissimilar metals.

FIG. 1 illustrates an exemplary electrical grounding device 10 that generally includes a body 12 having a first plate portion 14, a second plate portion 16, and a folding portion 18 therebetween. First plate portion 14 is generally rectangular and includes opposed first and second ends 20 and 22, opposed end edges 24 and 26, and opposed side edges 28 and 30. Second plate portion 16 is generally rectangular and includes opposed first and second ends 32 and 34, opposed end edges 36 and 38, and opposed side edges 40 and 42. Although described as generally rectangular, first plate portion 14 and second plate portion 16 may have any suitable shape that enables device 10 to function as described herein.

In the exemplary embodiment, grounding device body 12 is fabricated from dissimilar metal layers such that body 12 includes a first layer or surface 44 and an opposed second layer or surface 46. First surface 44 is fabricated from a first metal such as aluminum, and second surface 46 is fabricated from a different second metal such as steel. Alternatively, first and second surfaces 44, 46 may be fabricated from any suitable metal that enables device 10 to function as described herein. In the exemplary embodiment, first surface 44 and second surface 46 are coupled by cladding, i.e., a metallurgical bond created between two metals when they are pressed together under high-pressure, then heated to relieve stress and to allow metallurgical interdiffusion. As such, body 12 is a dissimilar metal sheet consisting of two or more layers of dissimilar metal that have been joined together by cladding. However, first surface 44 and second surface 46 may be joined together by any suitable process that results in no oxygen being present between the two surfaces such that the bond is corrosion free. Moreover, more than one metal layer may comprise first and second layers 44 and 46. For example, first layer 44 may include three dissimilar metal layers such that first layer 44 may be coupled to three corresponding dissimilar metal components.

Figure 2:
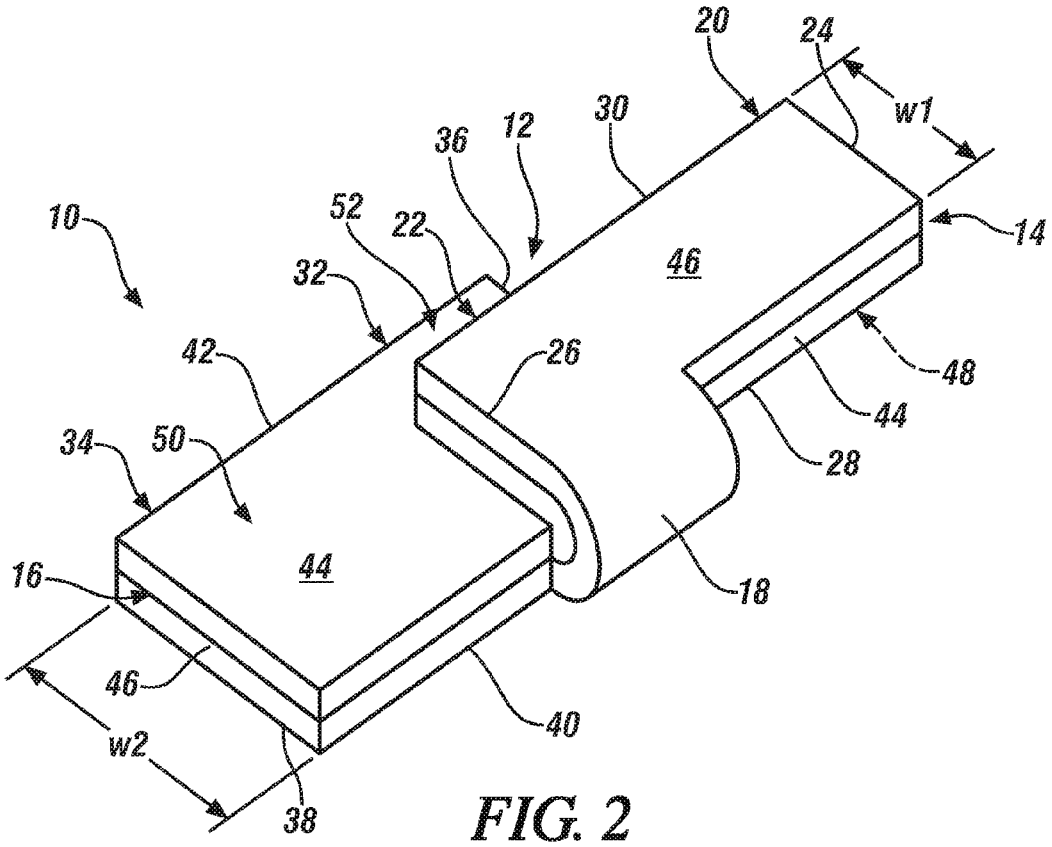
FIG. 2 is a perspective view of the electrical grounding device shown in FIG. 1 and after a folding process.

As shown in FIG. 2, first plate portion 14 is folded onto second plate portion 16 such that a portion of first metal surface 44 of first plate portion 14 contacts and is co-planar with a portion of first metal surface 44 of second plate portion 16. Folding portion 18 provides the clearance necessary to position first plate portion 14 flat against second plate portion 16. Additionally, first plate portion 14 may be spot welded to second plate portion 16 to further secure first plate portion 14 against second plate portion 16.

With further reference to FIG. 1, first plate portion 14 is staggered with relation to, or off-set from, second plate portion 16 such that when first plate portion 14 is folded over onto second plate portion 16, exposed first surfaces 48 and 50 are defined on first and second plate portions 14 and 16, respectively. As shown in FIG. 2, exposed first surfaces 48 and 50 are subsequently available for coupling to additional components, as is described herein in more detail. Further, in the exemplary embodiment, a width "w1" of first plate portion 14 is smaller than a width "w2" of second plate portion 16 such that an additional exposed first surface 52 is defined on second plate portion 16 and available for coupling to additional components.

Figure 3:
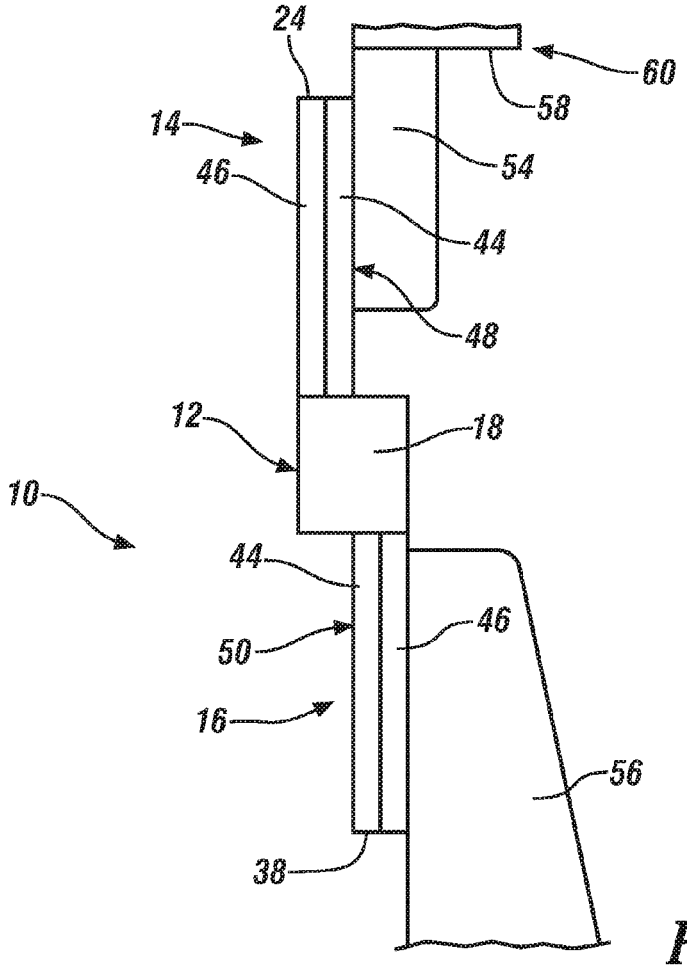
FIG. 3 is a side view of the electrical grounding device shown in FIGS. 1 and 2 and coupling two exemplary vehicle components.

FIG. 3 illustrates grounding device 10 used to mechanically and electrically couple a first component 54 and a second component 56. First component 54 and second component 56 are fabricated from dissimilar metals such that directly coupling components 54, 56 may cause a galvanic reaction causing oxidation and/or corrosion that may reduce or eliminate electrical contact therebetween. Accordingly, grounding device 10 is coupled between components 54 and 56 to facilitate preventing or reducing galvanic reactions. In the exemplary embodiment, first component 54 is a vehicle roof fabricated from aluminum, and second component 56 is a roof support pillar fabricated from steel. However, first and second components 54, 56 may be any number of different vehicle components fabricated from various metals.

In the exemplary embodiment, exposed first metal surface 48 of first plate portion 14 is coupled to first component 54. First metal surface 44 and first component 54 are fabricated from the same metal material (e.g., aluminum) such that the contact between the coupling surfaces does not cause a galvanic reaction. Second metal surface 46 of second plate portion 16 is coupled to second component 56. Similarly, second metal surface 46 and second component 56 are fabricated from the same material (e.g., steel) such that the contact between the coupling surfaces does not cause a galvanic reaction. In the exemplary embodiment, grounding device 10 is coupled to first and second components 54, 56 using a resistance weld. However, any suitable coupling process may be used that enables grounding device 10 to function as described herein. Alternatively, exposed first metal surface 50 and/or 52 of second plate portion 16 may be coupled to first component 54, and second metal surface 46 of first plate portion 14 may be coupled to second component 56. Further, the respective shapes and thicknesses of first and second plate portions 14, 16 may be adjusted to provide a desired orientation between or coupling to first and second components 54, 56.

In the exemplary embodiment, an electrical device 58 such as an antenna 60 may be coupled to first component 54. Alternatively, electrical device 58 may be any electrical device such as high-current devices, AC or DC motors, actuators, mechanical switch contacts, and electrical/electronic modules. To operate properly, electrical device 58 must be grounded. Accordingly, electrical grounding device 10 provides an electrical grounding path between first component 54 and second component 56, which reduces ground path resistance and grounds electrical device 58.

Figure 4:
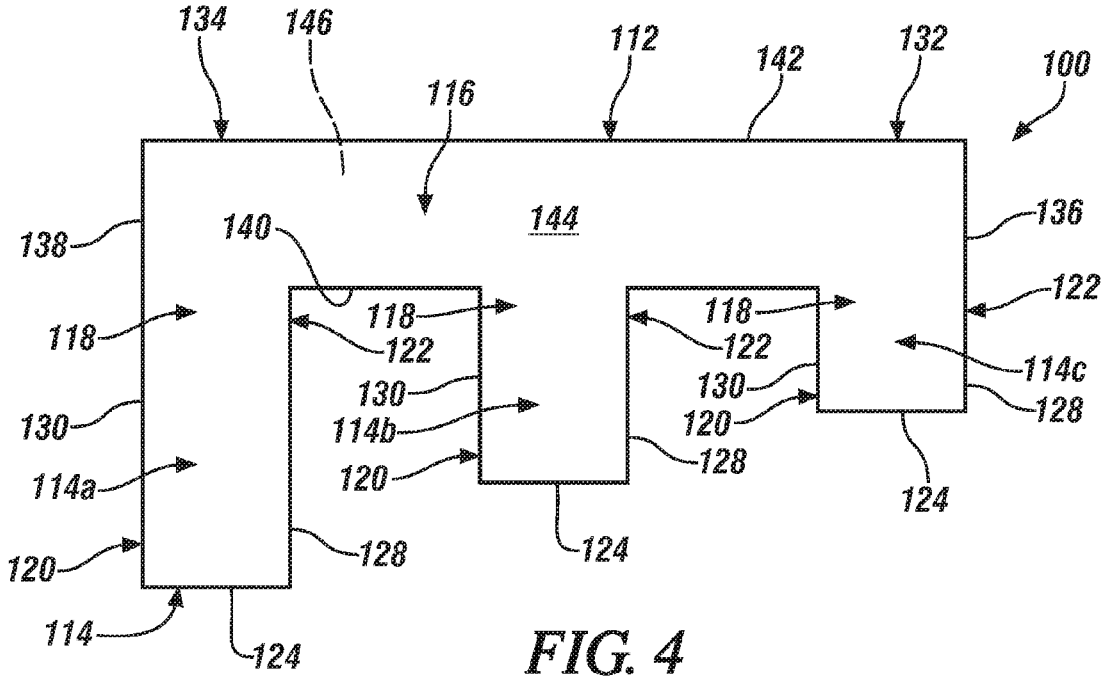
FIG. 4 is a schematic view of an exemplary structural device for coupling dissimilar metals and before a folding process.
Figure 5:
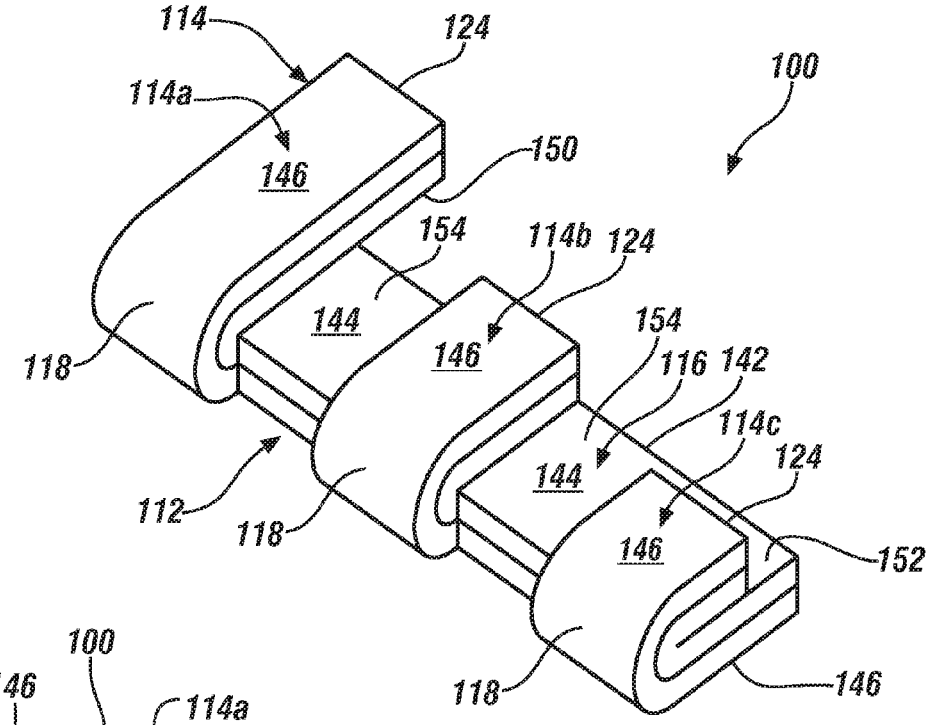
FIG. 5 is a perspective view of the structural device shown in FIG. 4 and after a folding process.
Figure 6:
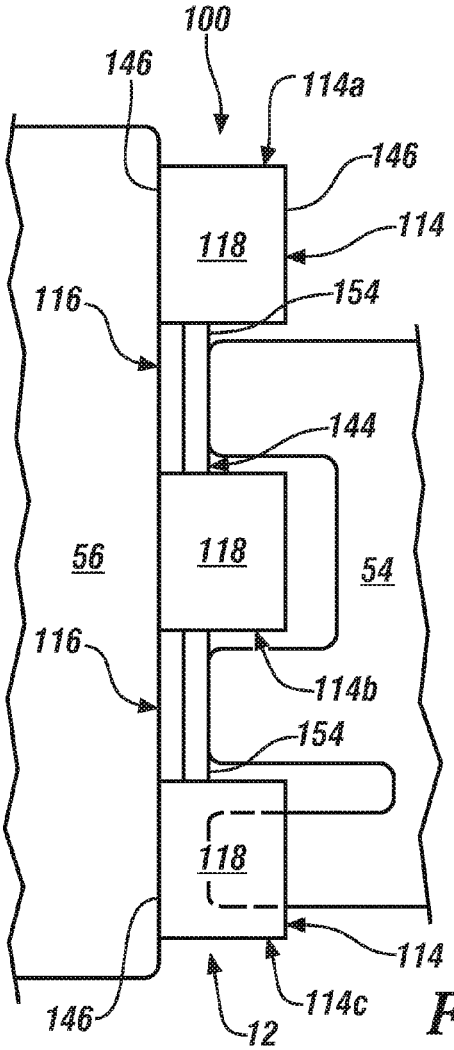
FIG. 6 is a side view of the structural device shown in FIG. 4 and coupling two exemplary vehicle components.

FIGS. 4-6 illustrate another exemplary coupling device 100 that may be used to couple and/or electrically ground dissimilar metal components. Device 100 is similar to device 10 except that it includes a plurality of first plate portions 114. Coupling device 100 generally includes body 112 having a plurality of first plate portions 114, a second plate portion 116, and folding portions 118 therebetween. First plate portions 114 are generally rectangular and each includes opposed first and second ends 120 and 122, end edges 124, and opposed side edges 128 and 130. Second plate portion 116 is generally rectangular and includes opposed first and second ends 132 and 134, opposed end edges 136 and 138, and opposed side edges 140 and 142. Although described as generally rectangular, first plate portions 114 and second plate portion 116 may have any suitable shape that enables device 100 to function as described herein.

Similar to device 10, body 112 is fabricated from dissimilar metal layers such that body 112 includes a first layer or surface 144 and an opposed second layer or surface 146. As shown in FIG. 5, first plate portions 114 are folded onto second plate portion 116 such that a portion of first metal surface 144 of first plate portions 114 contact and are co-planar with a portion of first metal surface 144 of second plate portion 116. Folding portion 118 provides the clearance necessary to position first plate portions 114 flat against second plate portion 116. Additionally, first plate portions 114 may be spot welded to second plate portion 116 to further secure first plate portions 114 against second plate portion 116.

In the exemplary embodiment, the length of each first plate portion 114 may be varied to facilitate a particular connection between components. As shown in FIG. 5, a first plate portion 114*a* has a longer length than a first plate portion 114*b*, which has a longer length than a first plate portion 114*c*. When first plate portion 114*a* is folded over onto second plate portion 116, an exposed first surface 150 is defined on first plate portion 114*a*. When first plate portion 114*b* is folded over onto second plate portion 116, edges 124 and 142 are substantially coplanar. And when first plate portion 114*c* is folded over onto second plate portion 116, an exposed first surface 152 is defined on second plate portion 116. Further, exposed first surfaces 154 are defined between folded first plate portions 114*a*, 114*b*, and 114*c*. Alternatively, the width of second plate portion 116 may be varied to define exposed surfaces on first plate portions 114 and/or second plate portion 116.

FIG. 6 illustrates coupling device 100 used to mechanically and electrically couple first component 54 and second component 56. Accordingly, coupling device 100 is coupled between components 54 and 56 in a manner similar to device 10. In the exemplary embodiment, first component 54 may be coupled to exposed metal surface 150 of first plate portion 114*a*, exposed first metal surface 152 of second plate portion 116, and/or exposed metal surfaces 154 of second plate portion 116, which are all fabricated from the same material (e.g., aluminum). Second metal surface 146 of second plate portion 116 is coupled to second component 56. Similarly, second metal surface 146 and second component 56 are fabricated from the same material (e.g., steel). In the exemplary embodiment, device 100 is coupled to first and second components 54, 56 using a resistance weld. However, any suitable coupling process may be used that enables grounding device 10 to function as described herein. Alternatively, or in addition, second metal surface 146 of first plate portions 114 may be coupled to second component 56. Further, the respective shapes and thicknesses of first and second plate portions 114, 116 may be adjusted to provide a desired orientation between or coupling to first and second components 54, 56. Although not shown, an electrical device 58 may be electrically coupled to first component 54 or second component 56.

Described herein are exemplary electrical grounding and coupling devices for coupling dissimilar metal components of a vehicle body. The grounding devices include a body formed from two or more dissimilar metals each corresponding to the dissimilar metal components to be joined. The differing metal surfaces of the body are each coupled to a similar metal component to provide couplings between surfaces of the same metal. Accordingly, the electrical grounding and coupling devices facilitate a mechanical and electrical coupling between dissimilar metal components to provide a ground path with improved conductance and reduced resistance for electrical components coupled to one or more of the dissimilar metal components of a vehicle body. As such, typical mechanical and electrical connections between components may be replaced, reducing extensive and costly copper wiring, reducing vehicle mass, and preventing corrosion at connection points.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An electrical grounding device for dissimilar metals, the device comprising:

a body comprising adjacent first and second plate portions, the body including a first surface formed from a first metal and an opposite second surface formed from a second metal, wherein the first plate portion is folded onto the second plate portion such that a portion of the first surface of the first plate portion contacts a portion of the first surface of the second plate portion, and wherein the first surface of the first plate portion is configured to couple to a first component formed from the first metal and the second surface of the second plate portion is configured to couple to a second component formed from the second metal, the body electrically coupling the first component and the second component to facilitate electrically connecting the first and second components.

2. The device of claim 1, wherein the first metal is aluminum and the second metal is steel.

3. The device of claim 1, wherein the portion of the first portion folded onto the second portion is spot welded thereto.

4. The device of claim 1, wherein the body first surface and the body second surface are clad to each other.

5. The device of claim 1, wherein the first plate portion comprises a first end and an opposite second end, and the second plate portion comprises a first end and an opposite second end, wherein the first plate portion and the second plate portion are staggered such that the first plate portion second end is adjacent the second plate portion first end.

6. The device of claim 1, wherein the body further comprises a folding portion oriented between the adjacent first and second plate portions.

7. The device of claim 1, wherein a width of the second plate portion is larger than a width of the first plate portion.

8. A vehicle comprising:

a first vehicle component fabricated from a first metal;

a second vehicle component fabricated from a second metal; and a coupling device comprising:

a body comprising adjacent first and second plate portions, the body including a first surface formed from the first metal and an opposite second surface formed from the second metal, wherein the first plate portion is folded onto the second plate portion such that a portion of the first surface of the first plate portion contacts a portion of the first surface of the second plate portion, and wherein the first surface of the first plate portion is coupled to the first vehicle component and the second surface of the second plate portion is coupled to the second vehicle component, the body coupling the first and second vehicle components.

9. The vehicle of claim 8, wherein the first metal is aluminum and the second metal is steel.

10. The vehicle of claim 8, wherein the portion of the first portion folded onto the second portion is spot welded thereto.

11. The vehicle of claim 8, wherein the body first surface and the body second surface are clad to each other.

12. The vehicle of claim 8, wherein the first plate portion comprises a first end and an opposite second end, and the second plate portion comprises a first end and an opposite second end, wherein the first plate portion and the second plate portion are staggered such that the first plate portion second end is adjacent the second plate portion first end.

13. The vehicle of claim 8, wherein the body further comprises a folding portion oriented between the adjacent first and second plate portions.

14. The vehicle of claim 8, wherein a width of the second plate portion is larger than a width of the first plate portion.

15. The vehicle of claim 8, wherein the first plate portion and the second plate portion are resistance welded to the first and second vehicle components, respectively.

16. The vehicle of claim 8, further comprising an electrical component electrically coupled to the first vehicle component, wherein the body electrically couples the first and second vehicle components to ground the electrical component.

17. The vehicle of claim 8, wherein the first vehicle component is a vehicle roof and the second vehicle component is a roof support pillar.

18. A method of manufacturing an electrical grounding device for dissimilar metals, the method comprising:

providing a body having a first surface formed from a first metal and an opposite second surface formed from a second metal;

forming the body to include adjacent first and second plate portions; and folding the first plate portion onto the second plate portion such that a portion of the first surface of the first plate portion contacts a portion of the first surface of the second plate portion, wherein the first surface of the first plate portion is configured to couple to a first component formed from the first metal, and the second surface of the second plate portion is configured to couple to a second component formed from the second metal, the body electrically coupling the first and second components.

19. The method of claim 18, wherein the providing a body comprises cladding a first metal layer to a second metal layer to form a body having a first surface formed from the first metal layer and an opposite second surface formed from the second metal layer.

20. The method of claim 18, further comprising resistance welding a first portion of the first surface of the first plate portion to a first vehicle component and resistance welding a portion of the second surface of the second plate portion to a second vehicle component.

* * * * *